United States Patent [19]

Walker et al.

[11] 4,133,992

[45] Jan. 9, 1979

[54] SELF-PURGING ELECTRICAL CONNECTOR

[75] Inventors: Raymond W. Walker, Huntington Beach; Robert M. Beard, Long Beach, both of Calif.

[73] Assignee: Compagnie Francaise des Petroles, France

[21] Appl. No.: 786,210

[22] Filed: Apr. 11, 1977

[51] Int. Cl.[2] ..... H01H 35/24; H01R 11/02

[52] U.S. Cl. ..... 200/81 R; 339/60 M; 339/61 M; 339/75 M

[58] Field of Search ..... 200/1 V, 16 B, 16 E, 200/81 R, 81.4, 83 R, 83 J, 61.08; 339/60 M, 61 M, 75 R, 75 M, 94 M

[56] References Cited

U.S. PATENT DOCUMENTS

| | | | |
|---|---|---|---|
| 3,657,681 | 4/1972 | Falkner | 336/61 M |
| 3,696,222 | 10/1972 | Langan et al. | 200/16 B |
| 3,784,959 | 1/1974 | Horton | 339/60 M |
| 3,848,949 | 11/1974 | Falkner | 339/75 M |

*Primary Examiner*—James R. Scott
*Attorney, Agent, or Firm*—Poms, Smith, Lande & Glenny

[57] ABSTRACT

A self-purging, hydraulically actuated electrical connector for use in a hostile environment, such as in deep sea water, comprising an elongated receptacle having a tapered longitudinal chamber provided with longitudinally and radially spaced fixed electrical contacts and an elongated tapered member receivable within said chamber and provided with longitudinally and radially spaced contacts movable in a radial direction to engage the fixed contacts. Fluid pressure actuating means are provided for driving the movable contacts into engagement with the fixed contacts. Orientation means for the receptacle and the tapered member assure juxtaposition of the fixed and movable contacts. The arrangement of electrical contacts includes elastomeric protective covers configured and cooperable with the contacts to purge sea water from the immediate vicinity of the contacts.

15 Claims, 5 Drawing Figures

23
12
24
21
51
71
14
70
45
48
50
40
42
39
69
95
96
29
25
41
83
36
83
20
17
19
63
55
85
80
60
80
55
62
78
89
88
66
56
75
90
84
65
35
75
64
58
87
15
85
18
59
77
81
79
64
58
35
57
87
68
28
77
37
56
65
76
55
84
81

SELF-PURGING ELECTRICAL CONNECTOR

BACKGROUND OF THE INVENTION

Prior electrical contacts for use in deep sea water or other hostile environment, such as outer space or nuclear irradiated atmosphere, have juxtaposed mating electrical contacts arranged in parallel planes with mating movement normal to the planes, see U.S, Pat. Nos. 3,657,681; 3,784,959; 3,848,949.

In deep sea operations, such as offshore drilling and production operations, prior electrical control systems were somewhat restricted in the number of mating electrical contacts because the diameter of the pipe or casing imposed a space limitation thereon restricted by such diameter. The planar area in which the electrical contacts were arranged was usually relatively small. Also, many prior underwater connectors characterized by juxtaposed planar arrangements of contacts often utilized gravitational forces to mate the contacts and mechanical springs were used to compensate for or equalize such forces. Such typical electrical connectors included a cylindrical body having the electrical contact elements provided at one end of the body, such as across the end face thereof.

SUMMARY OF INVENTION

The present invention relates to a self-purging hydraulically actuated electrical connector adapted for underwater operation and having a configuration characterized by providing electrical contacts along the length of the connector. The concept of providing electrical connectors along the length of a connector body is attractive for deep sea operations because in such operations the drilling or productions systems are characterized by length; that is, the systems extend for a few feet or for thousands of feet with minimal lateral size or dimension as contrasted with equipment adapted to be spread horizontally over a relatively unlimited area.

The primary object of the present invention, therefore, is to provide an underwater electrical connector utilizing elongated tapered geometry which readily lends itself to offshore well operations.

An object of the invention is to provide an electrical connector wherein electrical contacts are disposed in longitudinal and angular relation along the length of an elongated electrical connector means.

Another object of the invention is to provide an electrical connector wherein the contacts disposed in longitudinal spaced relation along the length of an elongated connector body are located on a tapered surface of the body whereby a mating electrical contact may be readily moved into juxtaposition by relative longitudinal movement of the electrical contacts to be connected.

Another object of the present invention is to provide means for readily and positively guiding separable connector body members along their longitudinal axes and for longitudinally positioning the two body members for proper mating of the electrical contacts.

A further object of the present invention is to provide an electrical connector means wherein one elongated body member is receivable within another elongated body member for longitudinally and radially positioning mating electrical contacts and wherein said contacts are protected by elastomeric material configured to positively purge foreign matter or fluid between the juxtaposed contacts to be mated.

A further object of the present invention is to provide an electrical connector of the type above described including means for angularly positioning the contact members on the connector body members in proper axial alignment for mating thereof by relative movement in a radial direction.

A still further object of the present invention is to provide an elongated electrical connector having one or more groups of electrical contacts arranged in transverse zones along its longitudinal axis and wherein said electrical contacts are mated simultaneously by hydraulic fluid under pressure.

A more specific object of the present invention is to provide an electrical connector utilizing fluid pressure actuating means and provided with penetrating contact elements acting like a piston in a cylinder under fluid pressure to cause electrical engagement of the penetrating contact element with a fixed contact element.

A still further object of the present invention is to provide an electrical connector having elonagted, separable body members on which mating electrical contacts are arranged both angularly and axially and wherein pressure compensating means are provided at one end of one of the body members.

Other objects of the present invention will be readily apparent from the following description of the drawings in which an exemplary embodiment of the invention is shown.

Figure 1:
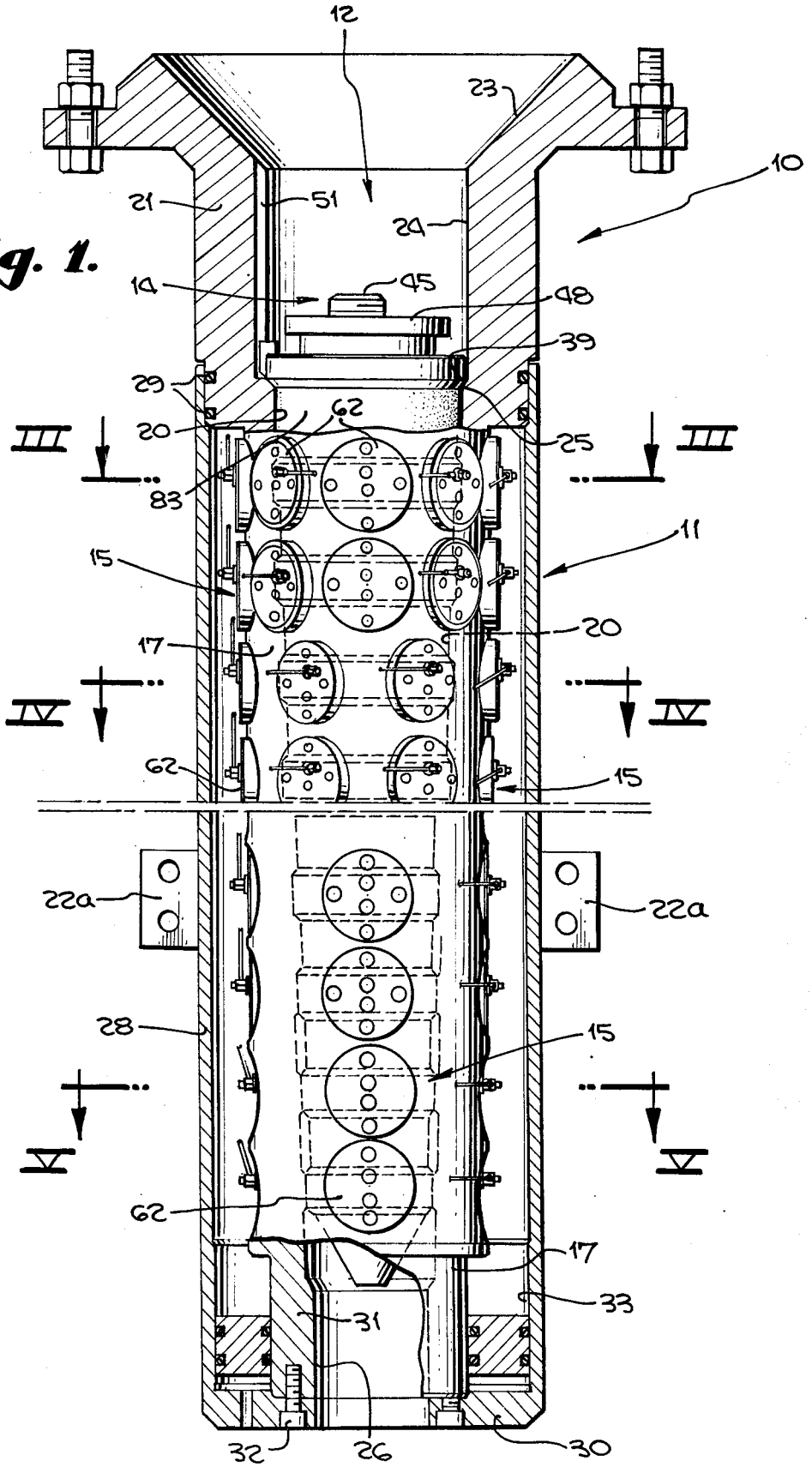
FIG. 1 is a sectional view of an electrical connector embodying this invention, the section being taken in a plane longitudinally bisecting the connector, the connector being broken at its middle portion for purposes of clarity.

In FIG. 1 an electrical connector, generally indicated at 10, embodying this invention comprises an elongated receptacle means 11 having a longitudinal axis and an interior, elongated chamber means 12 which receives through one end a separable, elongated, tapered member 14. A plurality of cooperable, electrical contact means, generally indicated at 15, are provided on said receptacle means within said chamber and on said elongated, tapered member 14. The electrical contact means are aranged in axially spaced, transverse zones. Electrical connector 10 is self-purging and adapted for use in a hostile or harsh environment as in deep water offshore well installations. An example of such use is as part of a control means for a deep sea riser system, the control means being located at a manifold means located on the sea floor and serving a plurality of satellite subsea wells, such as described in U.S. Pat. No. 4,098,333 owned by a common assignee.

Receptacle means 11 comprises an elongated, hollow body 17 having a conical wall 18 with a conical interior surface 19. Conical surface 19 defines a tapered receptacle chamber 20. Receptacle body 17 is provided with an upper cylindrical end portion 21 provided with a radially extending flange 22. Adjacent flange 22 upper body end 21 may be provided with an inwardly tapered surface 23 leading to a cylindrical passage 24 communicating with the tapered chamber 20 for reception therein of the conical, tapered member 14. Radial flange 22 and side cleats **22*a*** provide suitable means for securing the receptacle means to a subsea manifold structure or to other structures for carrying such an electrical connector.

The lower end of tapered chamber 20 terminates in a downwardly and inwardly directed conical surface 25 which may serve as a landing surface for the lower end of member 14. The lower end of the receptacle body 17 has a bottom opening 26.

Receptacle means 11 also includes a cylindrical housing 28 of uniform diameter and having an upper end sleeved over a reduced portion of the cylindrical upper end 21 of body 17 and sealed therewith by suitable seal rings as at 29. The lower end of housing 28 has an inturned flange 30 for securement to lower, reduced, cylindrical end portion 31 of body 17, as by a plurality of screw bolts 32. The lower end of housing 28 defines with the flange 30 and the lower end 31 of the receptacle body 17, an annular chamber 33 serving a pressure compensating purpose as later described.

Elongated, tapered or conical member 14 is provided with a wall 35 having an exterior conical surface 36 corresponding in taper to the conical or tapered surface 19 of the receptacle body. Wall 35 defines an elongated internal chamber 37 in the conical member 14, said chamber 37 being closed at its lower end by end 38. The upper end of member 14 is provided with external conical surfaces 39 for landing on corresponding conical surfaces 25 at the bottom of passage 24 to axially or longitudinally position member 14 within the receptacle chamber 21. The upper end of member 14 is provided with a threaded fitting 40 for closing and sealing the upper end of chamber 37. Fitting 40 is provided with a port 41 and a fitting 42 therefor adapted to provide a connection for conducting high pressure fluid into chamber 37. Fitting 40 also carries an electrical bulwark fitting 45 for passage therethrough in pressure sealed relationship, a plurality of electrical cables 46. The high pressure fluid may come from a hydraulic source within a control probe (not shown). Also, the electric cables connecting to 45 pass into the control probe.

The upper end of member 14 may also include a radial flange 48 adapted to provide a connection with a control probe means or other means for landing the tapered member 14 in the receptacle body.

Means for rotationally or angularly orienting tapered member 14 with the fixed receptacle means 11 is provided by a lug or key 50 carried by the upper end of member 14, key 50 extending radially outwardly of the member 14 for engagement with a longitudinal slot 51 provided in the internal surface of the cylindrical portion 21 of the receptacle body.

Electrical contact means 15 are provided both in the receptacle wall 18 and in the wall 35 of tapered member 14. A plurality of such cooperable, electrical contact means are shown, for brevity and clarity only one set of electrical contact means will be described.

In the receptacle body wall 18 and in a zone transverse to the longitudinal axis of the receptacle body may be provided a plurality of circularly spaced openings 55 within which is positioned an anvil or fixed contact disc 56 received within a cup-shaped, elastomeric cover 57. Cover 57 includes a wall 58 of selected thickness which protrudes inwardly from the conical surface 19. Side walls 59 of cover 57 are provided a tight, sealed fit between the circumferential edges of the contact disc 56 and the edges of opening 55. The walls 59 of cover 55 may include a radially extending flange 60 to facilitate sealing of cover 57 by providing an integral seal gasket to prevent leakage of the insulating oil in the annulus into the bore and to prevent displacement of cover 57 through opening 55.

Means for securing the electrical contact disc 56 and cover 57 in opening 55 includes a backup plate 62 seated in a circular recess 63 in wall 18 and having an inboard surface in abutment with contact disc 56. Backup plate 62 may be suitably secured by a plurality of screw bolts 64 to wall 18 and contact disc 56 may be secured to the backup plate by suitable screw bolt 65.

Also connected to contact disc 56 in a terminal pin or bolt 66 secured to contact disc 56 in electrically conductive relation and extending radially outwardly of backup plate 62 for a suitable clamped fitting 68 with an electrical wire 69 which leads to an electrical plug 70 suitably mounted in an opening 71 in the wall 21 of the receptacle body. The contact disc 56 is thus securely, immovably positioned in the opening 55 in conical wall 18 of the receptacle body.

Electrical contact means 15 also includes an electrical contact penetrating element 75 mounted in an opening 76 provided in wall 35 of the tapered member 14. Penetrating element 75 is carried in a rigid body of dielectric material 77 having a threaded mounting 78 in wall 35 and having an outwardly flared flange 79 provided with a sealing element 80 for sealing engagement with an exterior countersunk recess 81 in the outer surface 36 of wall 35.

The exterior conical surface 36 of wall 35 of member 14 may be ensleeved within a continuous boot or sleeve 83 of elastomeric material and having a selected thickness. At areas adjacent the penetrating element 75, the thickness of the elastomeric boot 83 may be increased to provide sufficient depth for the pointed, conical end 84 of penetrator element 75 and to provide an embossment 85 juxtaposed to elastomeric wall 58 covering the anvil contact disc 56. Thus, when the tapered member 14 is axially and rotationally oriented in the receptacle body, a penetrating contact element 75 will be juxtaposed to an anvil contact disc 56.

Penetrating element 75 carried within the rigid, dielectric plug 77 is provided at its inner end with suitable seal rings 87 so that said penetrating element 75 may act as a piston slidably movable in the cylindrical chamber 88 provided in plug 77. The back or interior end of pentrating element 75 provides a flat surface area for pressure fluid introduced into said cylindrical chamber 88 through a port 89 which leads to the interior of chamber 37. Also, an electrical line 90 is connected to element 75 and extends to and passes through sealed fitting 45 at the top end of the member 14.

Means for actuating penetrating electrical contact elements 75 to drive said penetrating elements through the elastomeric material 83 and the cover 57 into electrical contact engagement with the anvil disc 56 is provided by filling chamber 37 in conical member 14 with a dielectric pressure fluid, such as oil, through port 41. When the fluid in chamber 37 is placed under selected pressure, penetrating elements 75 are simultaneously actuated and are driven through the elastomeric covers 83 and 57. The pressure area at the end of each penetrating element 75 is relatively large so that when the pressure fluid reaches a pressure of between 1000 and 1500 psi, each penetrating element 75 will forcibly make electrical contact with its mating contact disc. The pressure of the fluid in chamber 37 is maintained by means of a suitable accumulator and fluid pump connected with the pressure fluid system within the control probe means.

Electrical contact means 15 are disengaged by retraction of penetrating elements 75 caused by reduction in fluid pressure in chamber 37 and by the action of the resilient forces in the elastomeric material 83 on penetrating elements 75. Conical pointed end 84 of each element when actuated into electrical contact with disc 56 wedges the material 83 forwardly and radially outwardly with respect to the axis of each penetrating element. Thus, material 83 is under compressive forces which include an axially directed force component. Thus, when there is a reduction of fluid pressure, the elastomeric material 83 seeks to regain its former position and exerts an axially directed force upon the penetrating element 75 to move element 75 axially away from its mating contact disc 56. In effect, the resiliency of the elastomeric material 83 acts as a spring force to bias the penetrating element into retracted position.

In operation of the electrical connector described above, receptacle means 11 may be fixed and secured with its axis vertically disposed. Tapered member 14 is lowered and guided by suitable well-known means into the top opening of the receptacle means. As tapered member 14 is further lowered, its conical bottom end will enter the cylindrical upper chamber 24 and then enter the tapered chamber 20 of the receptacle means. The angle of the taper on internal surface 19 of the receptacle means and the angle of the taper on the tapered member 14 is approximately the same and an example of the angle of such taper is about 3°.

Figure 2:
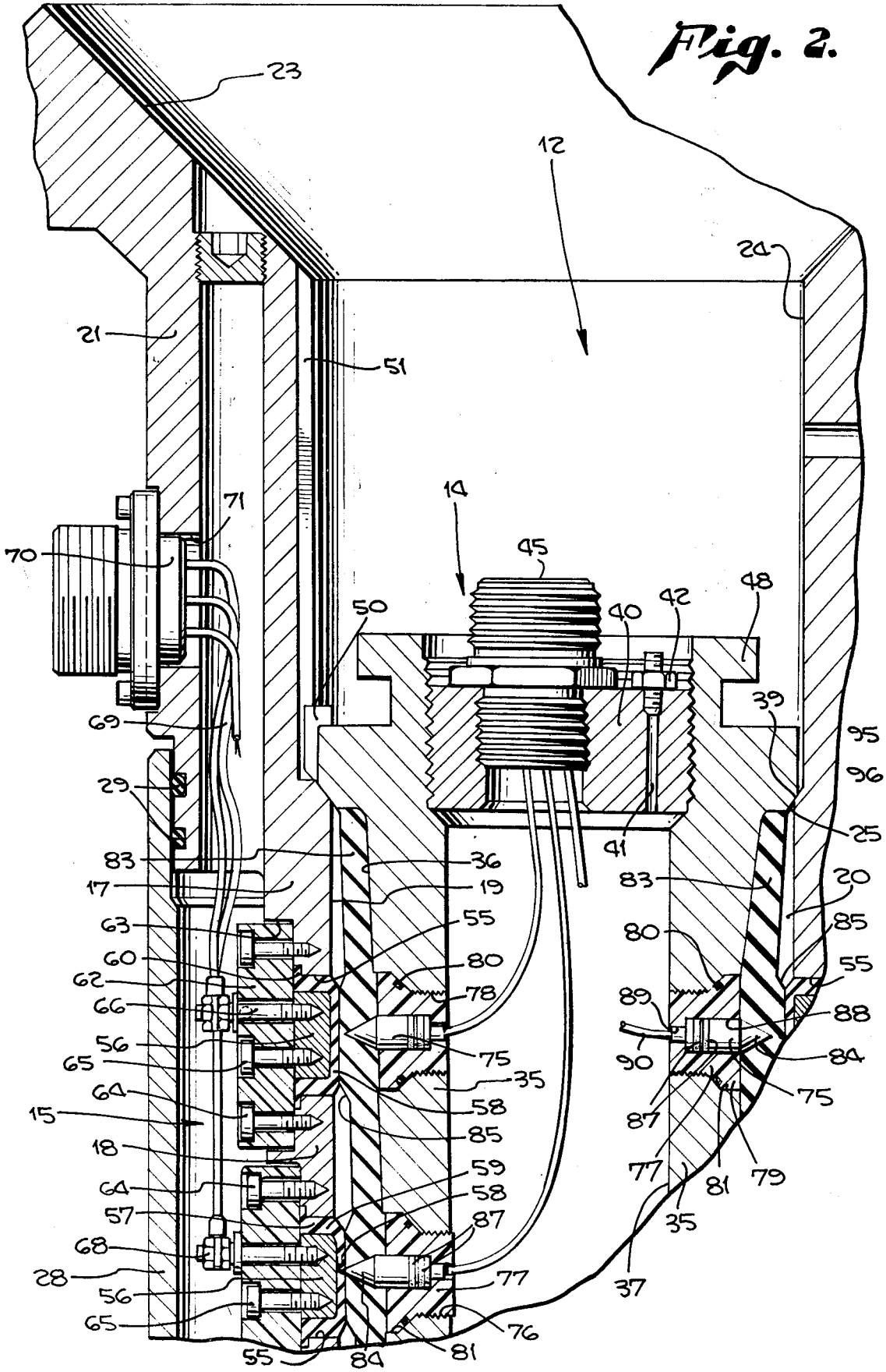
FIG. 2 is an enlarged, fragmentary sectional view of the upper portion of the connector shown in FIG. 1, the section being taken in a longitudinal plane bisecting both the receptacle body and the tapered member receivable there within.

As the upper portion of tapered member 14 enters the cylindrical upper chamber 24 of the receptacle means, the tapered member is more closely guided because of the tolerance at 95, FIG. 2, between the enlarged flange 96 of the upper end of the tapered member and the internal diameter of chamber 24. As flange 96 enters chamber 24, the tapered member is rotated until guide lug 50 engages key slot 51 to thereby angularly orient the tapered member 14 with respect to the receptacle means. Such angular orientation is predetermined so that penetrating elements 75 carried by the tapered member 14 will be juxtaposed to electrical contact disc 56 carried by the receptacle means for making and breaking electrical contact therewith. As the tapered member 14 is further lowered into the receptacle means, the tapered member becomes longitudinally or axially oriented with respect to the receptacle means by the landing of the bottom conical surface 39 on the conical landing surface 25 provided on the receptacle means.

Figure 5:
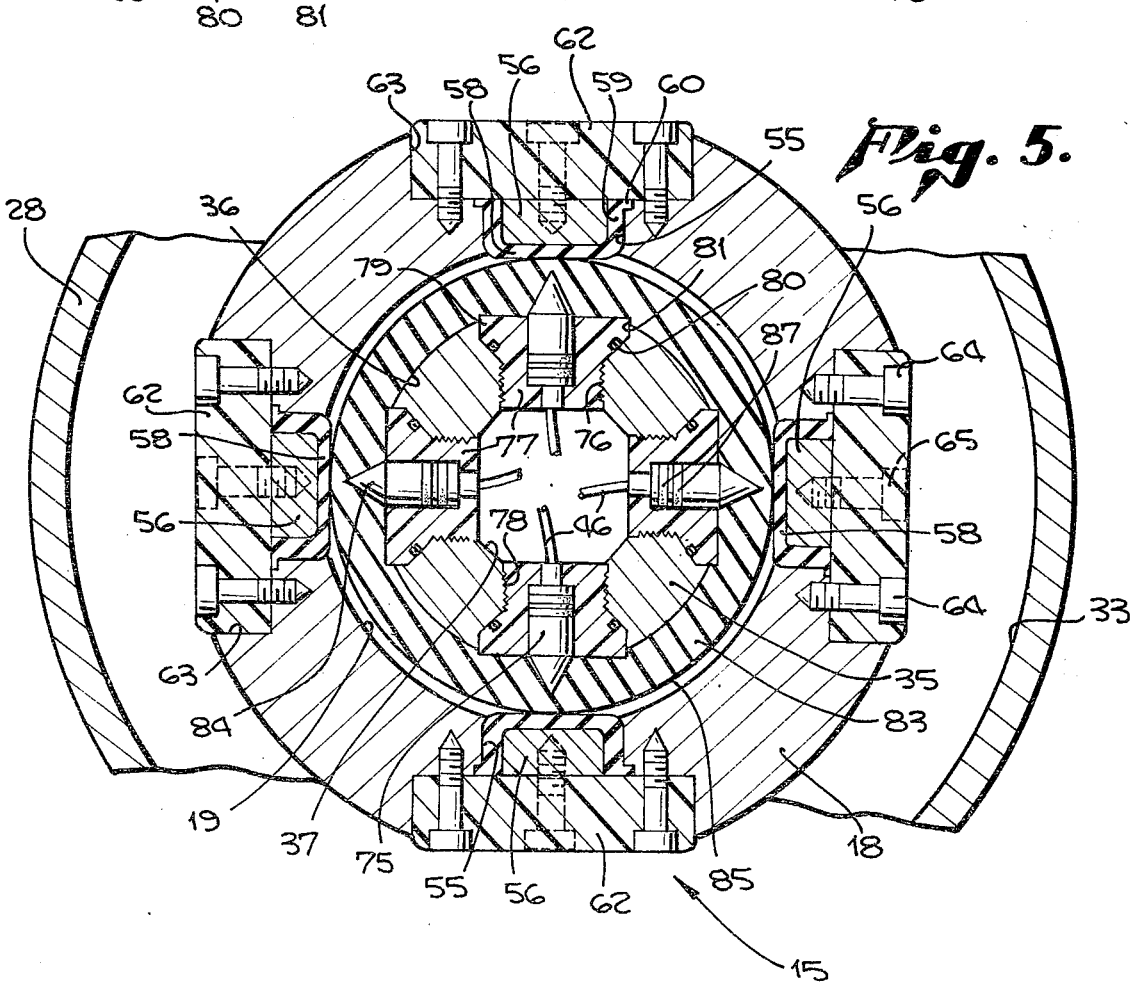
FIG. 5 is an enlarged, fragmentary, sectional view taken in the transverse plane indicated by line V — V of FIG. 1.

During entry of the conical member 14 into the chamber 20 under subsea conditions, it will understood that the chamber 20 may be filled with sea water. Sea water in chamber 20 is displaced through port 26 at the bottom of the receptacle means. It should also be noted that as the conical member moves axially into its final position, the protruding annular embossments 85 slidably contact the outer surface of wall 58 of the covering for the contact disc 56. As best seen in FIG. 5, the interface between the elastomeric material includes a flat face on wall 58 and a convex face on annular embossment 85. During movement into final axial position, the sliding engagement at the interface purges sea water from between the faces, particularly since in angular orientation the point on annular embossment 85 directly opposite the point of a penetrating element 75 is at the tangent of the circumferential surface of the embossment 85 to the planar flat face of the wall 58. Such tangential contact minimizes possible entrapment of sea water between the two faces. Such purging of sea water between the two faces is further accomplished when the penetrating elements are actuated in a radial direction and the point of the penetrating element exerts a radially outwardly directed force with respect to the axis of the penetrating element on the portions of the elastomeric material at the point of the penetrating element. Thus, when the penetrating element pierces the elastomeric embossment 85 and further pierces the wall 58, sea water will be pushed radially outwardly with respect to the axis of the penetrating element and purged and driven into the annular space between the connector elements.

It will also be apparent that upon retraction of the penetrating elements the elastomeric material will resiliently contract and close any opening made by the penetrating element 75.

Figure 3:
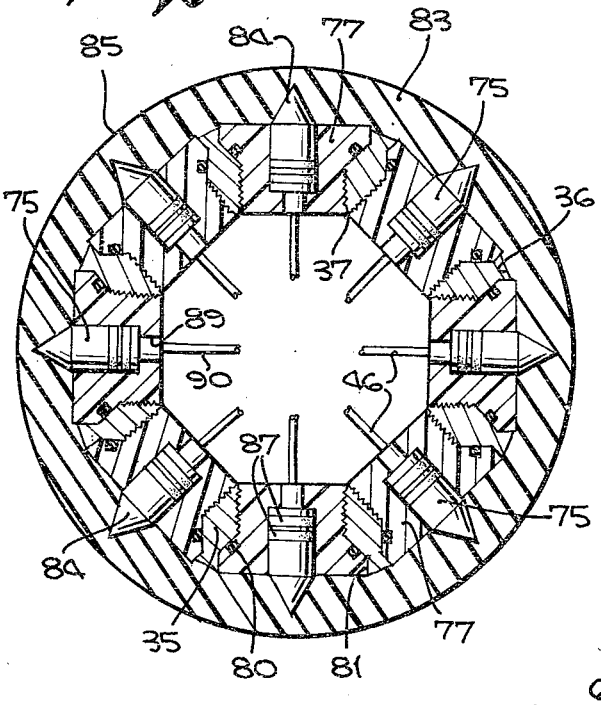
FIG. 3 is a transverse, sectional view taken in the transverse plane indicated by line III — III of FIG. 1.
Figure 4:
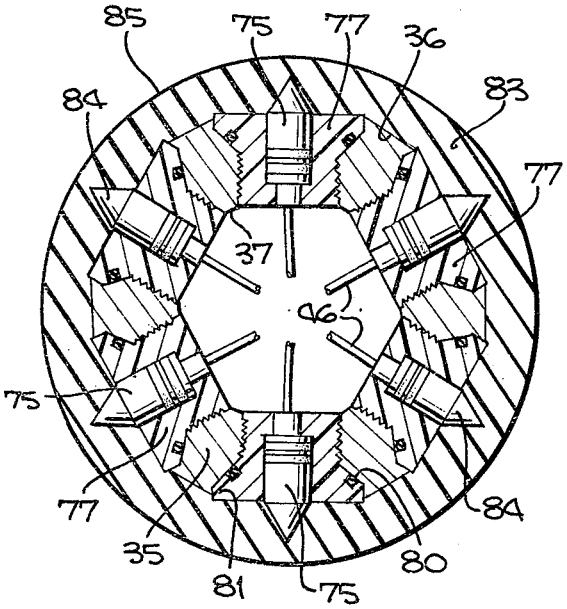
FIG. 4 is a transverse, sectional view taken in the plane indicated by line IV — IV of FIG. 1.

As shown in FIGS. 3, 4 and 5, the number of electrical contact means provided in a transverse zone through the electrical connector 10 is dependent upon the diameter of the tapered member 14 and the tapered chamber 20 into which it is received. In the example shown, the lower end of the electrical connector includes four electrical connecting means 15 disposed at 90° to each other, FIG. 5. As further shown in FIG. 1, four connecting means 15 lie in the plane indicated by line V — V and constitute a group of four connectors. Above and below plane V — V are additional groups of four connectors. All of said groups of four connectors are identified as a set of groups of connectors. At an intermediate portion of the electrical connector means, the diameter thereof is sufficient to provide in each transverse zone groups of six electrical connector means, FIG. 4. At the uppermost end of the electrical connector means, adjacent transverse zones may include groups of eight electrical connector means, FIG. 3. The arrangement of an increasing number of electrical connector means 15 in a group vary along the length of the electrical connector 10 and provides an effective arrangement of electrical connector means, the number of which is dependent upon the length of the connector means and the changing diameter of the taper of the tapered member 14 and tapered chamber 20. Thus, in subsea well operations, an electrical connector of the type described above may be provided a multiple number of connectors dependent upon the length and diameter of the connector and all of the electrical connector means may be simultaneously actuated by the pressurized dielectric fluid in the hollow core chamber of the tapered member 14.

It will be understood that various modifications and changes may be made in the electrical connector described above and which come within the spirit of this invention and all such changes and modifications coming within the scope of the appended claims are embraced thereby.

We claim:

1. An electrical connector comprising:

an elongated receptacle body having a longitudinal axis and a tapered, elongated chamber along said axis, said chamber having an open end;

an elongated, tapered member receivable through said open end in coaxial relation with said chamber and axis;

a plurality of cooperable electrical contact means on said body in said chamber and on said member, said contact means being in spaced relation longitudinally of said axis and in angular spaced relation;

means for longitudinally positioning and rotationally orienting said tapered member with respect to said receptacle body for juxtaposing each of said electrical contact means on said body with a mating electrical contact means on said member;

and fluid pressure means for actuating said electrical contact means.

2. An electrical connector as stated in claim 1 wherein said electrical contact means on said tapered member include piston and cylinder means.

3. An electrical connector as stated in claim 1 wherein said tapered member is provided with a hollow elongated chamber;

said electrical contact means on said tapered member including piston and cylinder means;

and said fluid pressure actuating means including pressure fluid in said hollow chamber on said tapered member for actuation of said piston and cylinder means to make electrical contact with said electrical contact means on said receptacle body.

4. An electrical connector as stated in claim 1 wherein said longitudinal positioning means includes a landing surface on said receptacle body for positioning said tapered member.

5. An electrical connector as stated in claim 1 including a housing enclosing said receptacle body and defining an annular chamber therewith, said annular chamber being filled with a dielectric fluid.

6. An electrical connector as stated in claim 5 including pressure compensating means at one end of said annular chamber, said pressure compensating means having communication with ambient fluid pressure of a hostile environment in which the connector is used.

7. In self-purging, electrical connector adapted for use in a hostile environment under varying pressures; the combination of:

an elongated, hollow receptacle means open at one end and having a conical interior surface generated about the longitudinal axis of said receptacle means;

electrical contact means at said interior surface said facing said axis;

each of said contact means having an elastomeric protective covering;

an elongated, hollow, conical member for reception through said one end into said hollow receptacle means along the longitudinal axis thereof, a plurality of electrical contact members carried by said conical member and facing away from said axis and toward contact means on said receptacle means;

an elastomeric protective covering over each of said contact members;

and means for fluid pressure actuation of the electrical contact members on said conical member for penetration of said protective coverings for making an electrical contact with the electrical contact means on the receptacle means.

8. A connector as stated in claim 7 wherein said electrical contact members are driven in a radial outward direction with respect to said axis.

9. An electrical connector as stated in claim 7 wherein said hollow, conical member includes a chamber filled with pressure fluid for actuating said electrical contact members simultaneously.

10. A connector as stated in claim 7 wherein said electrical contact means and members are arranged in axially spaced zones transverse to said axis of the connector means.

11. A connector as stated in claim 7 wherein said electrical contact members are provided in axially spaced zones, the number of electrical contact members in each axial zone being related to the diameter of the conical member and receptacle body at said axis zone.

12. A connector as stated in claim 7 including an external housing for said receptacle means;

said housing including, at one end, fluid pressure equalizing means between said housing and said receptacle means.

13. A connector as stated in claim 7 wherein said electrical contact means and members are arranged in sets of groups lying transversely of the axis of said connector means, the number of contact means and members in each set of groups progressively decreasing as the diameter of said conical configuration of the receptacle means and conical member decreases.

14. A connector as stated in claim 7 including means on said receptacle means and means on said conical member for rotationally orienting said conical member in said receptacle means.

15. An electrical connector as stated in claim 7 including means for limiting axial movement of said conical member within said receptacle means for axially orienting said electrical contact means and members.

* * * * *

UNITED STATES PATENT AND TRADEMARK OFFICE

CERTIFICATE OF CORRECTION

PATENT NO. : 4,133,992

DATED : January 9, 1979

INVENTOR(S) : Raymond W. Walker, Robert M. Beard

It is certified that error appears in the above-identified patent and that said Letters Patent are hereby corrected as shown below:

Column 4, line 23, change "in" to -- is --. Column 8, line 36, change "axis" to -- axial --.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*